US005956906A

United States Patent [19]

Berich et al.

[11] Patent Number: 5,956,906

[45] Date of Patent: Sep. 28, 1999

[54] ADJUSTABLE SUPPORT BRACE

[76] Inventors: Todd A. Berich, 3424 E. Jamison Pl., Littleton, Colo. 80122; Billy R. Parsons, 4115 S. Ensenada St., Aurora, Colo. 80013

[21] Appl. No.: 08/982,994

[22] Filed: Dec. 2, 1997

[51] Int. Cl.[6] ..... E04H 12/20

[52] U.S. Cl. ..... 52/149; 52/150; 52/151; 52/152; 52/745.11; 52/745.13; 52/749.1

[58] Field of Search ..... 52/149, 150, 151, 52/152, 745.1, 745.11, 745.12, 745.13, 745.14, 749.1

[56] References Cited

U.S. PATENT DOCUMENTS

| | | | |
|---|---|---|---|
| 3,874,625 | 4/1975 | Hansen et al. | 52/149 X |
| 4,068,427 | 1/1978 | Camardo | 52/149 X |
| 4,070,833 | 1/1978 | Hancock | 52/149 X |
| 4,083,156 | 4/1978 | Tye | 52/149 X |

OTHER PUBLICATIONS

Etkin Construction Comapny: Engineering report on "Bracing of CMU Walls in Windy Conditions", prepared Nov. 1997 by Karl R. Nelson and Candace S. Ammerman, 15 pages.

Temporary Bracing For Masonry Walls: Published by Construction Safety Association of Ontario, 74 Victoria Street, Ontario, Canada M5C 2A5, telephone 416/366–1501, 8 pages, 1982.

Block Brace Assembly: By D.K. Kelly dated Jul. 7, 1992, 2 pages.

Block Wall Bracing: By Richmond Screw Anchor Company, Fort Worth, Texas, Nov. 3, 1993. Brace data May 1997, Mighty Maxi Brace Aug. 1990, Aug. 1991 & Aug. 1992 by Richmond Screw Anchor Co.

*Primary Examiner*—Christopher T. Kent
*Attorney, Agent, or Firm*—Pittenger & Smith, P.C.

[57] ABSTRACT

An adjustable brace for a wall constructed from concrete masonry units or brick or precast. The brace has a inner member with a first section, a second section, and a center section connecting the first and second sections and having a connection for attaching the inner member to the wall. The brace also has a outer member, having a first section, a second section, and a center section connecting the first and second sections of the outer member and a connection for attaching the outer member to the inner member. The center section of said inner member and the center section of the outer member are connected to the wall such that the inner member and the outer member may rotate independent of each other about the connection. When the outer member is attached to the inner member, the first and second sections of the outer member are also placed directly against the wall. Extendable arms, located in the first and second sections of the inner member and in the first and second sections of the outer member, may be extended to provide support to additional areas of the wall.

19 Claims, 8 Drawing Sheets

ADJUSTABLE SUPPORT BRACE

FIELD OF THE INVENTION

The present invention relates to the construction of walls. Specifically, the present invention relates to a brace used for the construction of a wall. More specifically, the present invention relates to an adjustable brace that may be extended to support areas of a wall as the wall is constructed.

BACKGROUND OF THE INVENTION

The concrete masonry unit (CMU) and brick are preferred building materials used in the construction of a wide variety of structures. The CMU is durable, relatively inexpensive, and allows the construction of vertical walls having strong integral support in a relatively short time. Walls built from CMUs are built by stacking the blocks on top of each other in successive layers, each layer separated by an application of mortar. While mortar is designed to set up and cure relatively quickly, the uppermost part of the wall is considered "green" or less stable than lower areas of the wall. As CMU walls are often built quite high and may have considerable horizontal dimensions, the large area often associated with CMU construction often makes the wall vulnerable to wind, which may cause the collapse of all or part of the wall during construction.

To provide support to the wall during construction, a pole brace may be used to stabilize the wall at a single point. The pole brace is typically built from steel, has a fixed length, and incorporates a connecting bracket located at each end. The pole brace is attached to the wall by placing one of the connecting brackets over a bolt that is driven through the wall, and placing the other connecting bracket over another bolt that is secured to the ground in a caisson, footing, or by other methods. Pole braces are often used at several locations on a wall during construction.

The pole brace is only able to provide support at the point where it is attached, and only supports the wall as long as the block and mortar holds the attaching bolt. Another significant shortcoming of the pole brace is that the pole brace cannot support the wall at the weakest area, the "green" upper region, because the pole brace must constantly be repositioned. While the positioning of pole braces to stabilize points in the wall provides some degree of safety, positioning a large number of pole braces delays the construction time and thus increases the cost of the wall. Thus, the current practice of reinforcing CMU walls during construction through the use of pole braces limits the safety afforded workers and property as well as delays the time in which a wall may be constructed. An attempt to solve this problem has involved the placement of a board between the pole brace connection and the bolt driven through the wall. In addition to the weak support of such boards, a board cannot be extended, and must be repositioned just as a pole brace used without a board. There is a great need in the construction industry for an adjustable brace that may be applied quickly and effectively to reinforce new areas of a CMU wall as the wall is being constructed.

SUMMARY OF THE INVENTION

The present invention achieves a significant advance over the prior art by providing an adjustable brace that may expand to support areas of a CMU wall during construction instead of bracing individual points. The present invention incorporates extendable members that may be adjusted to support additional areas of a wall as they are constructed without having to be removed and reinstalled at a different location. Thus, the present invention allows the construction of a CMU wall with better support that can be built in less time than using conventional braces and techniques.

In one aspect, the present invention provides an adjustable brace for a constructing a vertical surface. The brace has a first member with a first section, a second section, and a center section connecting the first and second sections and having a connection for attaching the first member to the vertical surface. The brace also has a second member, having a first section, a second section, and a center section connecting the first and second sections of the second member and a connection for attaching the second member to the first member. A connection attaches the center section of said first member and the center section of the second member to the wall such that the first member and the second member may rotate independent of each other about the sleeved connection. The sleeved connections are fastened through the wall on either side, and attached on the opposite side of the wall by means of a bolt/coil rod to which the adjustable braces are attached. The center section of the first member is attached between the first and second sections such that all three sections share a common surface that is placed directly against the wall. The center section of the second member is attached between the first and second sections of the second member such that when the second member is attached to the first member, the first and second sections of the second member are also placed directly against the wall. Thus, an entire area of the wall is supported rather than individual points.

In the preferred embodiment, the first member also may include a mounting plate having coil rod, threaded bores, capable of receiving a threaded stud. The mounting plates may be included at a plurality of locations proximate to the center section of the first member. When the threaded stud is fastened in a threaded bore, the mounting plate provides a connection for a pole brace to attach between the adjustable brace and the ground.

Telescoping arms, contained in the first and second section of the first member and also in the first and second section of the second member, may be extended to provide support to increased area of the wall. A cross brace, attached between adjacent telescoping arms, may also be included to provide additional support. The cross brace also incorporates a telescoping arm, so that it may be attached between the adjacent telescoping arms at any desired orientation. Preferably, the cross brace is attached to the uppermost telescoping arms, thus providing support to the "greenest" portion of the wall. By extending the uppermost telescoping arms and the telescoping arm of the cross brace, the cross brace may be repeatedly adjusted and extended to continuously support the "greenest" portion of the wall.

In the preferred embodiment, locating tabs are integrated into the construction of the telescoping arms to locate the telescoping arms inside their respective sections of the first and second members. Corresponding locating tabs are integrated in the construction of the first and second sections of both the first and second members. These locating tabs, while locating the telescoping arm, also remove foreign debris such as mortar from the telescoping arm as it is retracted into its respective section. These tabs also serve to provide a stop mechanism that prevents the telescoping arm from dislocating from its respective section.

Locating feet may be located on the telescoping arm. These feet are also integrated into the construction of the telescoping arms, and place the telescoping arm in contact with the wall when the telescoping arm is extended.

In yet another aspect, an alternative embodiment of the present invention provides an adjustable brace for a constructing a vertical surface. The brace has a single member having one or more telescoping arms.

In another aspect, the present invention provides a method of bracing an area of a CMU wall during construction. The method includes the following steps: (a) providing an adjustable brace having two or more relatively long members, the members having telescoping arms that may extend from the respective members; (b) mounting the adjustable brace to the wall with a connection attaching the centers of the members to the wall such that the members may rotate independently of each other; (c) attaching an extendable cross brace between the uppermost ends of the respective members; (d) attaching a pole brace between the ground and the adjustable brace; and (e) extending the telescoping arms upward from the members while extending the attached cross brace between them, thus bracing additional areas of the wall as they are constructed.

In the preferred embodiment, the method repeats the above steps for an additional adjustable brace located on the opposite side of the wall as the first adjustable brace, where the two adjustable braces share a common connection to the wall.

In yet another aspect, the present invention provides a method of bracing an area of a wall during construction. The method includes the following steps: (a) providing an adjustable brace having a single, relatively long member, the member having one or more telescoping arms that may extend from the members; (b) mounting the adjustable brace to the wall by its center such that the member may rotate about the connection; (c) attaching a pole brace between the ground and the adjustable brace; and (d) extending the telescoping arms from the member, thus bracing additional areas of the wall as they are constructed.

In the preferred embodiment, the method repeats the above steps for an additional adjustable brace located on the opposite side of the wall as the first adjustable brace, where the two adjustable braces share a common connection to the wall.

Other features and advantages of the present invention will become apparent from the following detailed description of the invention when it is considered in conjunction with the accompanying drawings.

DETAILED DESCRIPTION OF THE DRAWINGS

Figure 1:
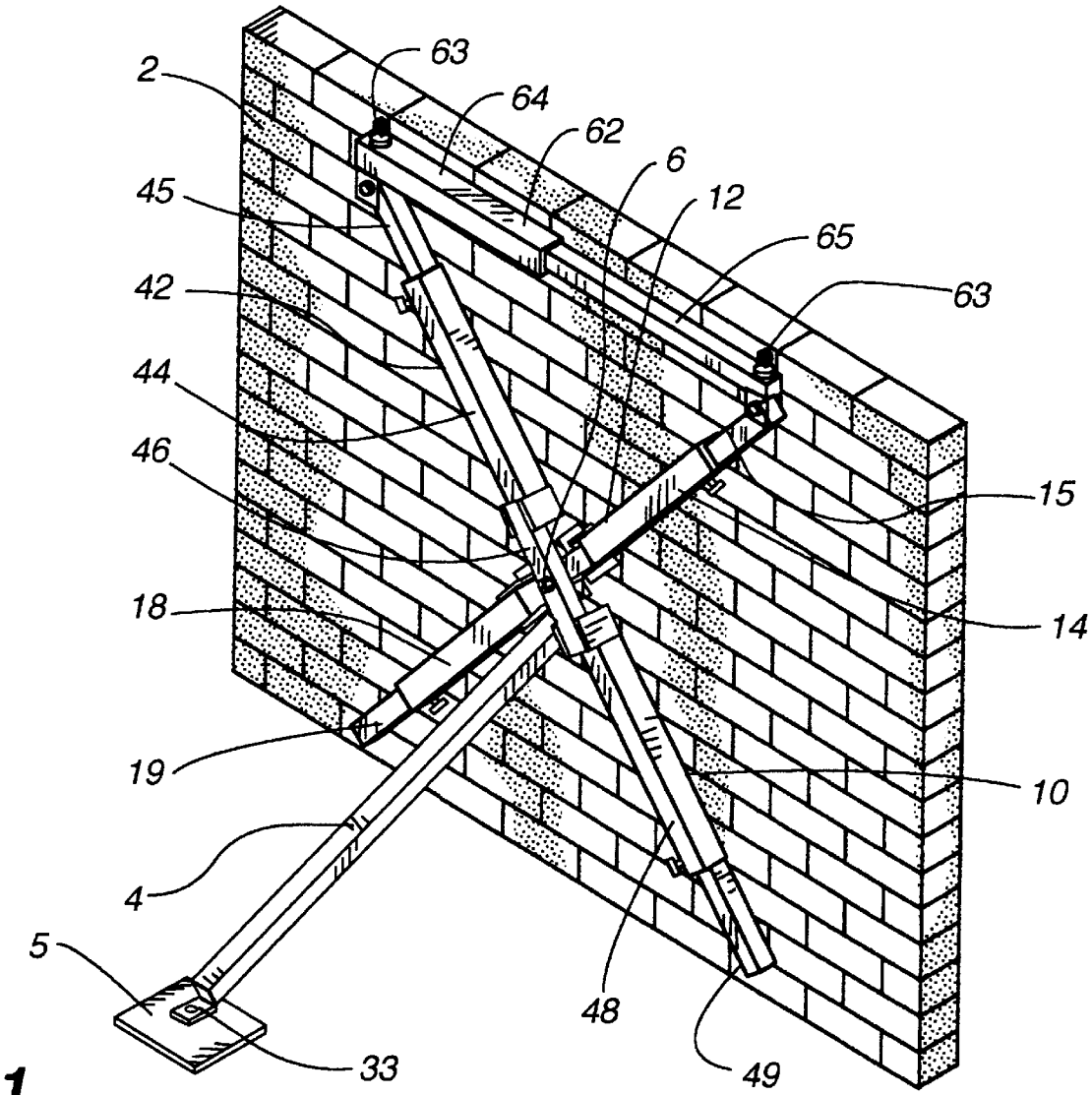
FIG. 1 illustrates the present invention as applied in the construction of a vertical wall.
Figure 4A:
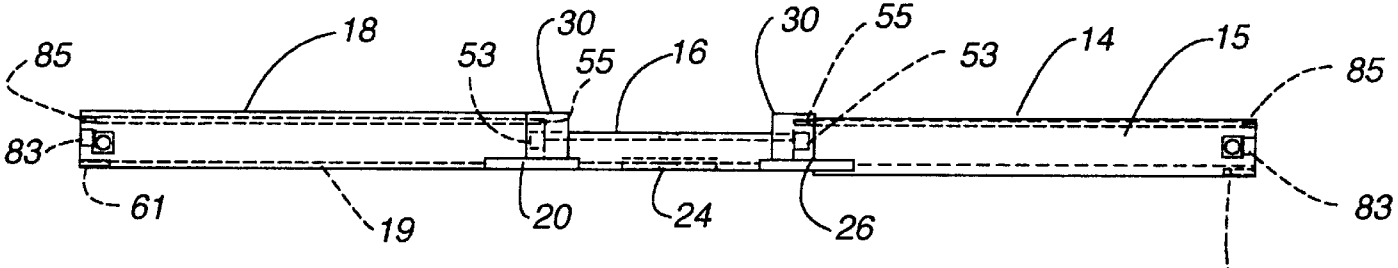
FIG. 4A is a plan view of top side of the inner member of the present invention.
Figure 4B:
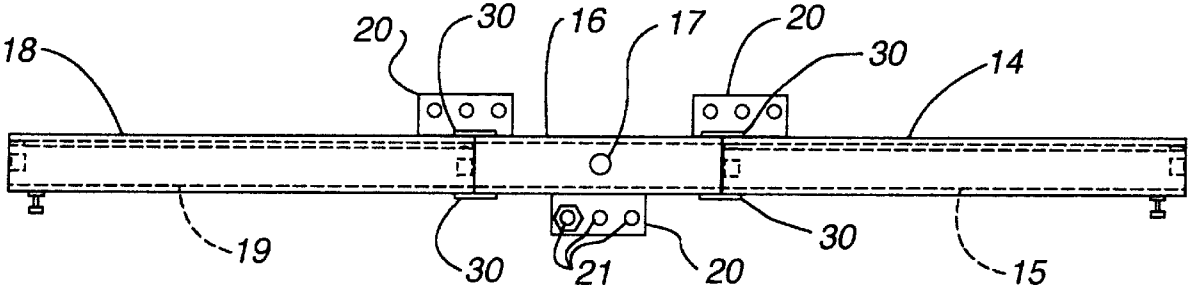
FIG. 4B is a section view of the inner member of the present invention.
Figure 4C:
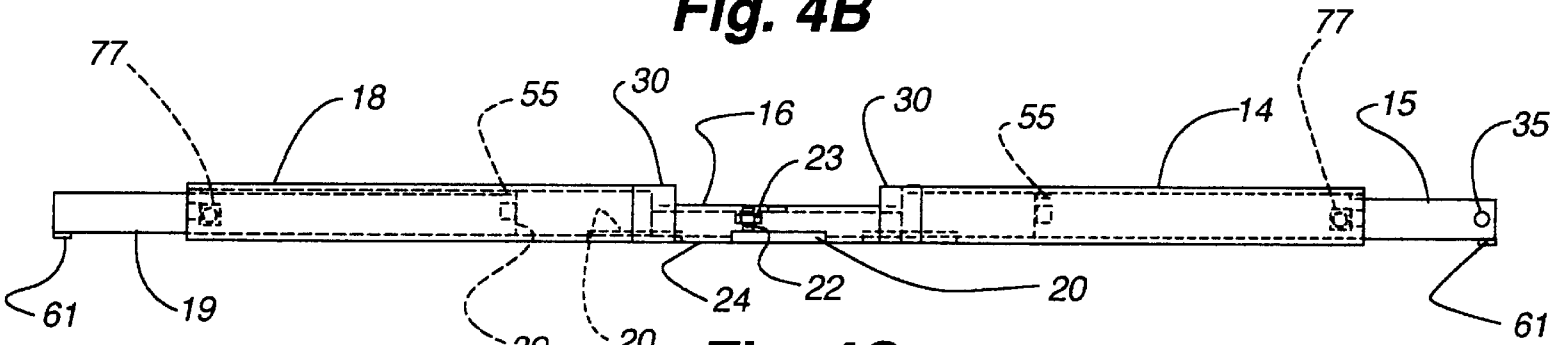
FIG. 4C is a plan view of the bottom side of the inner member of the present invention.
Figure 5A:
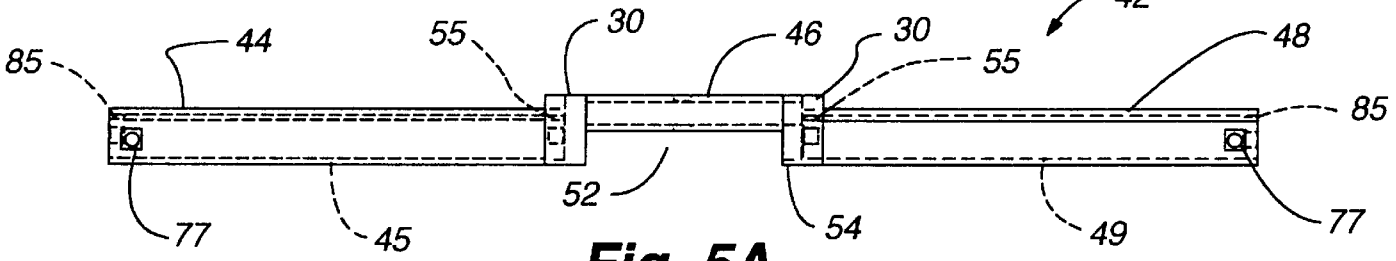
FIG. 5A is a plan view of bottom side of the outer member of the present invention.
Figure 5B:
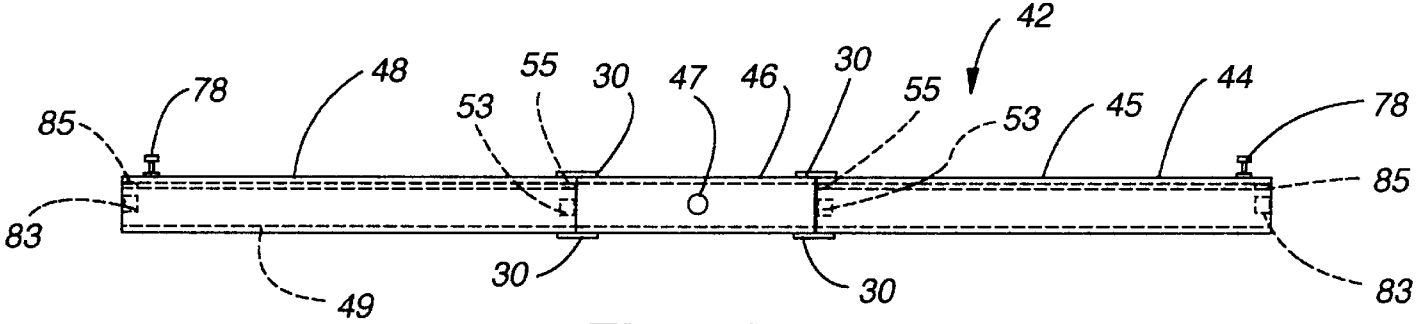
FIG. 5B is a section view of the outer member of the present invention.
Figure 5C:
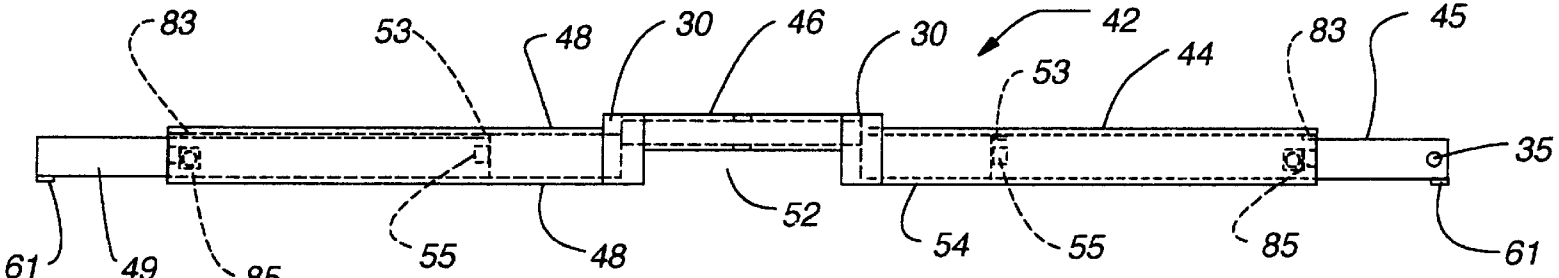
FIG. 5C is a plan view of the top side of the outer member of the present invention.
Figure 6A:
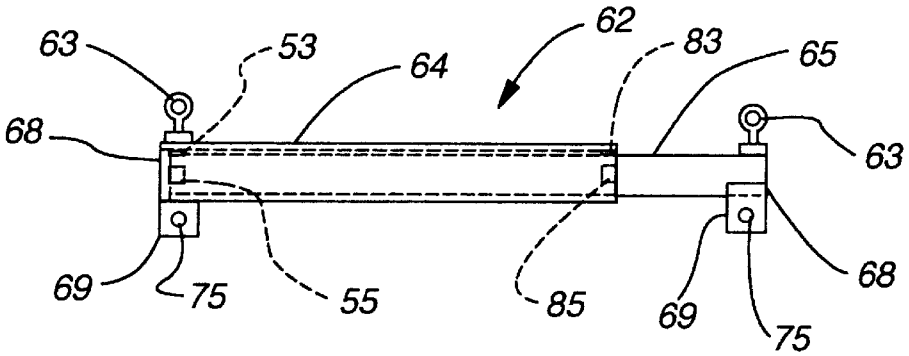
FIG. 6A is a section view of the cross brace with the telescoping arm in a retracted position.
Figure 6B:
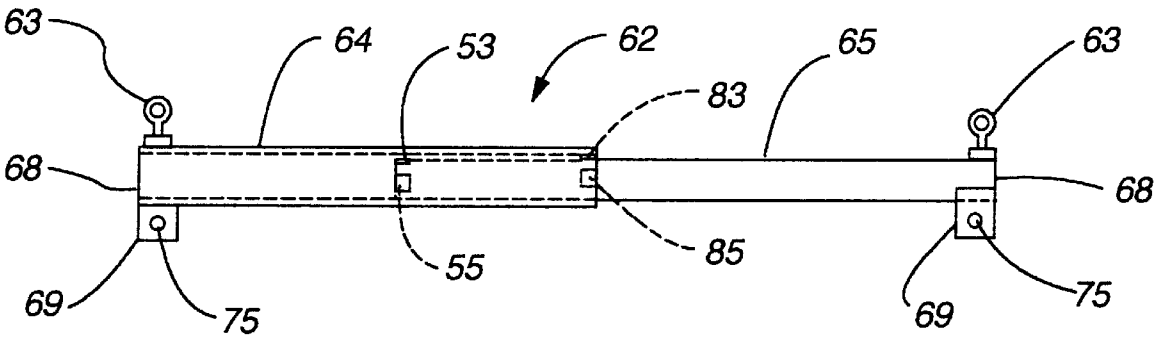
FIG. 6B is a section view of the cross brace with the telescoping arm in an extended position.

Turning now more specifically to the drawings, FIG. 1 illustrates the present invention as used in the construction of a wall made from CMU. The adjustable brace 10 is fastened to a wall 2 to provide structural support during construction. Adjustable brace 10 comprises an inner brace 12, an outer brace 42, and a cross brace 62. The inner brace 12 comprises a top section 14, a center section 16, and a bottom section 18. The outer brace 42 comprises a top section 44, a center section 46, and a bottom section 48. Reinforcement plates 30 are flanged steel plates which connect the center section 16 between the top section 14 and bottom section 18 on the inner brace 12. Reinforcement plates 30 also connect the center section 46 between the top section 44 and bottom section 48 on the outer brace 42. As illustrated in FIGS. 4A and 4C, the center section 16 of the inner brace 12 is connected between top section 14 and bottom section 18 such that all three sections share a continuous edge 24 that may be placed directly against the wall 2. As illustrated in FIG. 5A and 5C, the center section 46 of the outer brace 42 is elevated slightly. The clearance 52 between the center section 46 and edge 54 is sufficient to accommodate the center section 16 of inner brace 12.

Figure 2:
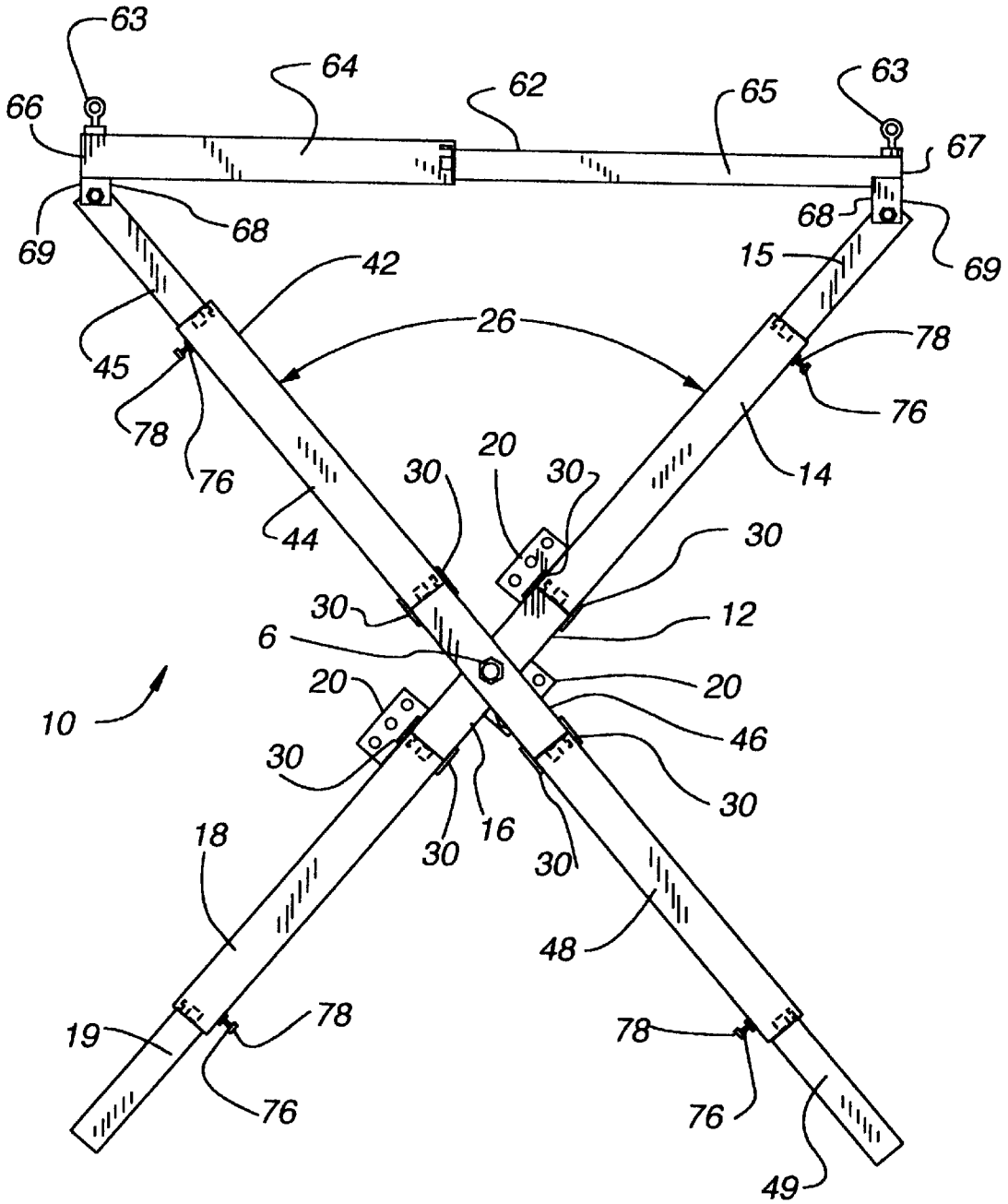
FIG. 2 is a section view illustrating the adjustable brace of the present invention.
Figure 3:
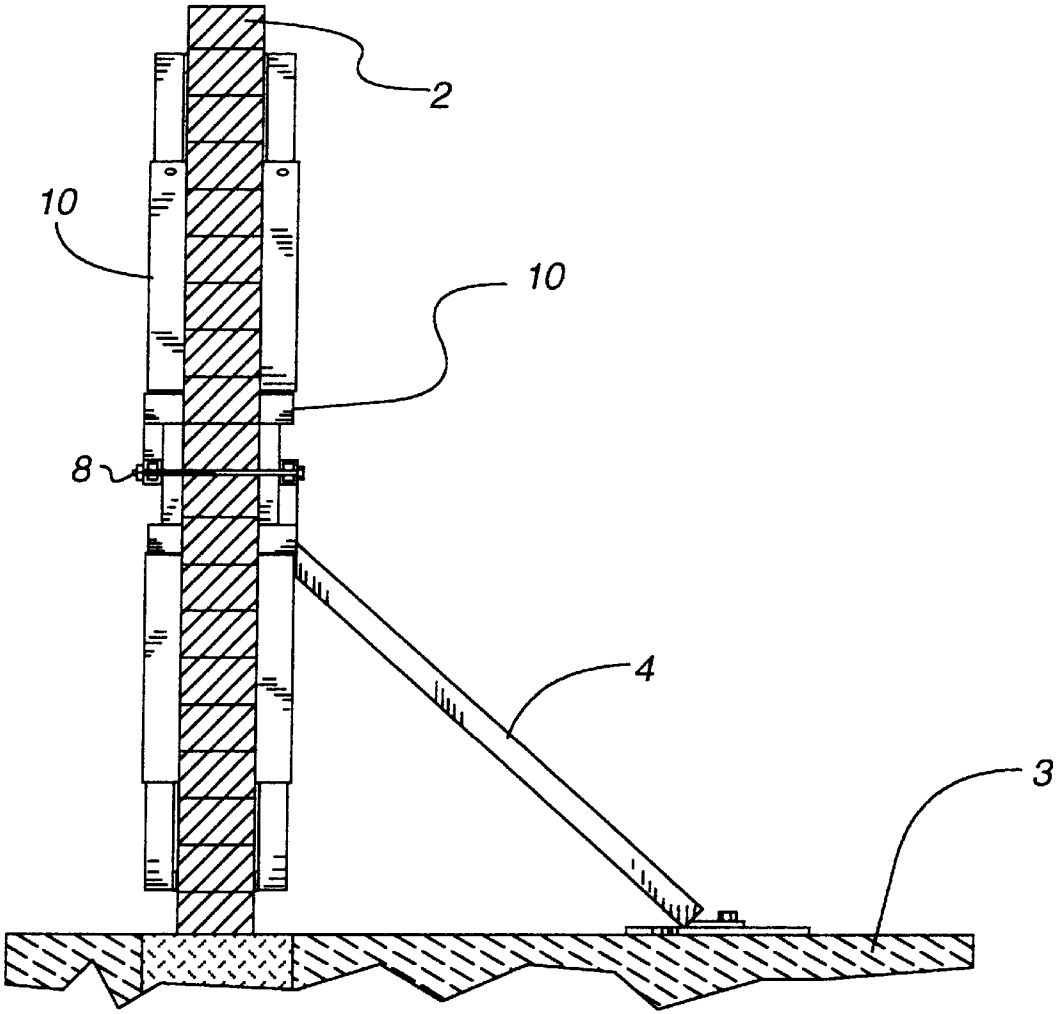
FIG. 3 is a section view illustrating the adjustable braces of the present invention attached to both sides of a vertical wall.

The inner brace 12 and outer brace 42 are placed in a vertical, crosswise orientation against the wall 2 such that the center section 16 of the inner brace 12 opposes the center section 46 of outer brace 42 and is positioned between the wall 2 and the center section of outer brace 42. Thus, top section 14, bottom section 18, top section 44 and bottom section 48 are all positioned flush against the wall 2. While in the preferred embodiment, the adjustable brace comprises a single outer brace 42, multiple outer braces may be configured in the adjustable brace, simply by locating center section 46 with a sufficient clearance 52 to allow rotation of the other braces. The adjustable brace 10 is fastened to the wall 2 by a bolt 6 that is placed through a bore 17 in center section 16, a bore 47 in center section 46 and extended through the wall 2 to a fastener 8 on the opposite side of the wall 2. The inner brace 12 and outer brace 42 may pivot about the bolt/sleeve 6, such that the angle 26 between the inner brace 12 and the outer brace 42 may be adjusted as desired. If the wall 2 is curved or has cylindrical shape, the adjustable brace 10 maybe adjusted so that angle 26 is relatively small; conversely, if the wall 2 is planar and has a wide area, the adjustable brace 10 may be adjusted so the angle 26 is sufficiently wide for the adjustable brace 10 to support a broad area. As the wall 2 is constructed, the adjustable brace 10 may be adjusted and extended to support areas of the wall 2 as they are constructed. A pole brace 4 attaches to the adjustable brace 10 and extends to an attachment 5 in the ground 3. As shown in FIG. 2, the bolt 6 may be extended to fasten an additional adjustable brace 10 attached to the opposite side of the wall 2, such that the wall 2 is supported on both sides by an adjustable brace 10.

The top section 14 and bottom section 18 of inner brace 12 are hollow and accommodate telescoping arms, as do the top section 44 and bottom section 48 of outer brace 42. The outer dimensions of each telescoping arm are smaller than the inner dimensions of the respective host sections so that sufficient clearance is provided to allow the telescoping arm to easily extend or retract. The telescoping arms allow the adjustable brace 10 to extend to positions that support increased area as the wall 2 is constructed. Top section 14 incorporates telescoping arm 15, bottom section 18 incorporates telescoping arm 19, top section 44 incorporates telescoping arm 45, and bottom section 48 incorporates telescoping arm 49.

Cross brace 62 may be attached to adjacent telescoping arms to provide additional structural support to wall 2. In the preferred embodiment, cross brace 62 is attached to telescoping arms 15 and 45 and provides structural support at the uppermost part of adjustable brace 10. To allow inner brace 12 and outer brace 42 to be rotated to desired orientations, cross brace 62 comprises a hollow cross section 64 that receives telescoping arm 65. Similar to the top and bottom sections of the adjustable brace 10, the length of the cross brace 62 may be adjusted by extending or retracting the telescoping arm 65. Cross brace 62 incorporates brackets 68 at end 66 of cross section 64 and the end 67 of telescoping arm 65. Bracket 68 consists of flanged extensions 69 that are positioned in opposing pairs that span the outer dimension of a telescoping arm. In the center of each flanged extension 69, an aperture 75 is provided with a sufficient diameter to receive a threaded bolt 70. In the preferred embodiment, telescoping arms 15 and 45 contain apertures 35 which are also of a sufficient diameter to receive bolt 70. Cross brace 62 is attached to adjustable brace 10 by aligning telescoping arms 15 and 45 within the brackets 68, inserting threaded bolts 70 through apertures 35 and 75, and fastening threaded bolts 70 with threaded nuts 71.

Screw eyes 63 may be located at end 66 of cross member 64 and also at end 67 of telescoping arm 65. The screw eye 63, located on a surface opposite the bracket 68, is incorporated into the cross member 62 to provide an attachment by which the adjustable brace 10 may be lifted to or lowered from the area of application on wall 2.

Figure 8:
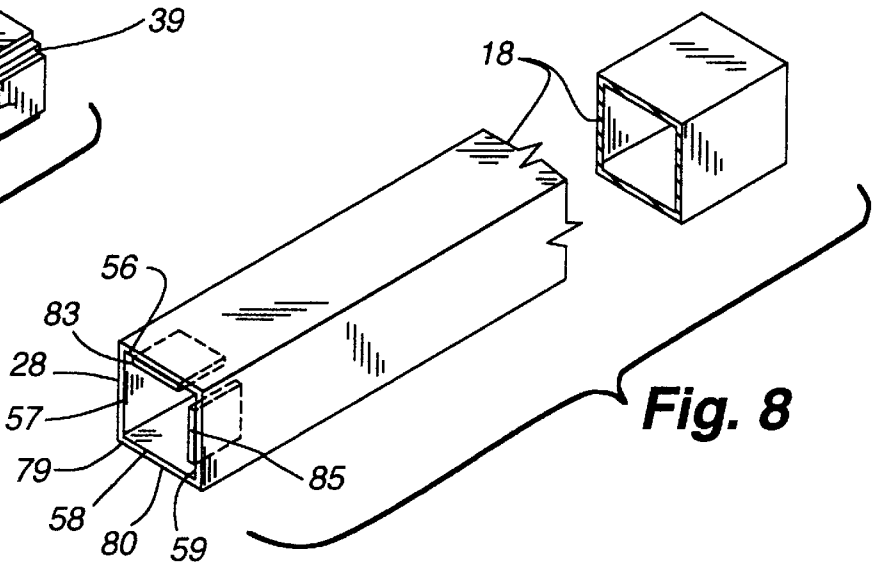
FIG. 8 is a perspective view of the bottom section of the first member with locating tabs.
Figure 7:
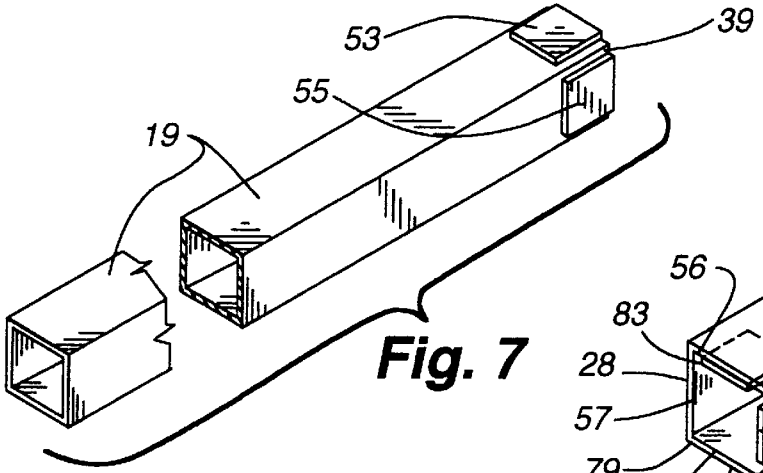
FIG. 7 is a perspective view of a telescoping arm with locating tabs.
Figure 10:
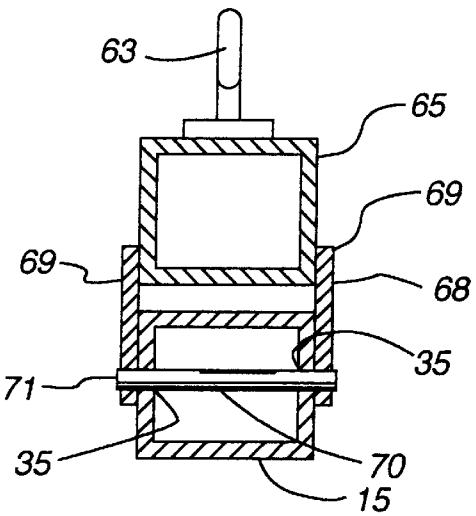
FIG. 10 is a profile view of the telescoping arm of the cross brace connected to the telescoping arm of the top section of the inner member.

To compensate for the clearance between the telescoping arm and its respective host section, locating tabs may be located on the surface of each telescoping arm to position the telescoping arm inside the host section. As shown in FIG. 7, tabs 53 and 55 are located on the end 39 of telescoping arm 19. Tab 53 positions telescoping arm 19 with respect to inner surfaces 62 and 57 within section 18, while tab 55 positions telescoping arm 19 with respect to inner surfaces 56 and 58 within bottom section 18. In the preferred embodiment, tabs 53 and 55 are constructed from carbon steel or other suitable material and are welded into place on telescoping arm 19. However, other materials and attachment methods may also be used. Similar locating tabs are provided at end 79 of bottom section 18. As shown in FIG. 8, tabs 83 and 85 are connected to inner surfaces 56 and 59 of bottom section 18, respectively. In addition to locating telescoping arm 19 within bottom section 18, tabs 83 and 85 also serve to remove debris such as mortar from telescoping arm 19 that may have been deposited on telescoping arm 19 when telescoping arm 19 was extended. By retracting telescoping arm into the bottom section 18, tabs 83 and 85 wipe the debris from the telescoping arm 18.

By providing locating tabs 53 and 55 on the telescoping arm 19 and providing tabs 83 and 85 on the bottom section 18, the locating tabs 53 and 83, as well as 55 and 85, may be brought into contact with each other and serve as a stop or retainer to prevent the telescoping arm 19 from completely dislocating from bottom section 18.

Figure 9:
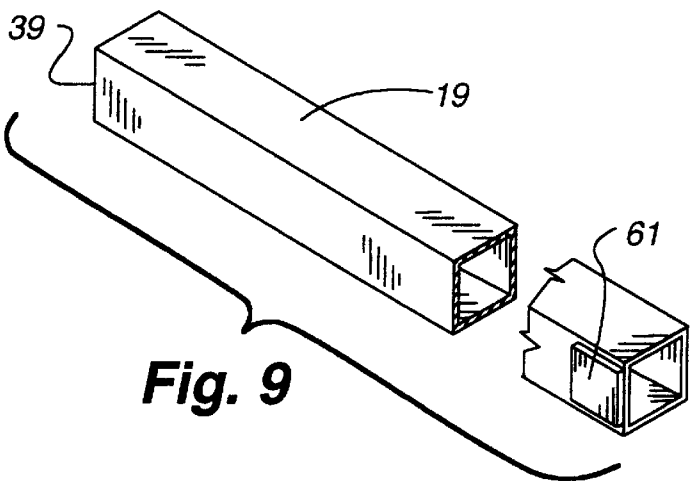
FIG. 9 is a perspective view of a telescoping arm with a locating tab that locates the telescoping arm proximate to a wall.

As illustrated in FIG. 9, a foot 61 may be located at end 39 of the telescoping arm 19. Foot 61 may also be a flanged steel plate that is welded or otherwise integrated into the structure of telescoping arm 19. Foot 61 is approximately the thickness of the side 28 of bottom section 18 (FIG. 8). When telescoping arm 19 is extended, foot 61 is located between the wall 2 and the telescoping arm 19, and places telescoping arm 19 in contact with wall 2.

Once extended to a desired extension, telescoping arm 19 may be affixed at that location by fastener 78. Fastener 78 consists of a threaded bore 77 located in the bottom section 18 at end 79. By inserting threaded bolt 76 into threaded bore 77 and driving it against telescoping arm 19, telescoping arm 19 may be extended and affixed at a desired length. In the preferred embodiment, fastener 78 is located on the downward facing surface 80 of bottom section 18 to prevent contact with debris such as mortar.

It is to be understood that while FIGS. 7 through 9 and the above discussion describe locating tabs 53, 55, 83, and 85, foot 61 and fastener 78 with reference to bottom section 18 and telescoping arm 19, locating tabs 83 and 85 as well as fastener 78 may also be located on each of top sections 14 and 44, bottom section 48, and cross section 64. Locating tabs 53, 55 and foot 61 may also be provided on telescoping arms 15, 45, 49, and 65.

The pole brace 4 may be attached to the adjustable brace 10 at any of several locations. Pole brace 4 is commonly used throughout the masonry industry for the construction of CMU walls. Pole brace 4 integrates fasteners 33 located at both ends. Fastener 33 is configured to receive a bolt and allows a nut to be fastened to the bolt, thus securing the pole brace 4. By securing one fastener 33 to the wall 2 and the other fastener 33 to the ground, the pole brace stabilizes the wall 2 at a single point. Inner brace 12 comprises a mounting plate 20 that may be provided at several locations along center section 16. In the preferred embodiment, mounting plate 20 is a flanged plate that is integrated into the construction of center section 16. Mounting plate 20 contains several threaded bores 21 which receive threaded stud 22. When inner brace 12 is placed against wall 2, mounting plate 20 is put in contact flush with wall 2. Fastener 33 is then placed over threaded stud 22 and secured with a threaded nut 23. In this manner, adjustable brace 10 increases the stability provided by the pole brace 4 from a single point to a wide area that is supported by the adjustable brace 10. By providing several threaded bores 21 on the mounting plate 20, the threaded stud 22 may be located as necessary to allow adjustable brace 10 to be adjusted to desired orientations. If the adjustable brace must be readjusted to a different orientation, a different threaded bore 21 or mounting plate 20 may accommodate threaded stud 22. Also if desired, pole brace 4 may be attached to the adjust brace 10 by directly affixing fastener 33 to bolt 6.

In the preferred embodiment, rectangular, extruded carbon steel is used in the construction of the inner brace 12, outer brace 42, cross brace 62, and telescoping arms. However, different material and shapes may be used. While telescoping arms are utilized in the preferred embodiment, any configuration that affords extendable length to inner brace 12 and outer brace 42 may be used. If the adjustable brace 10 is to be used on a delicate surface, such as tile or material having a finished or contoured surface, soft material such as cloth or carpet may be placed between the wall 2 and the adjustable brace.

Figure 11:
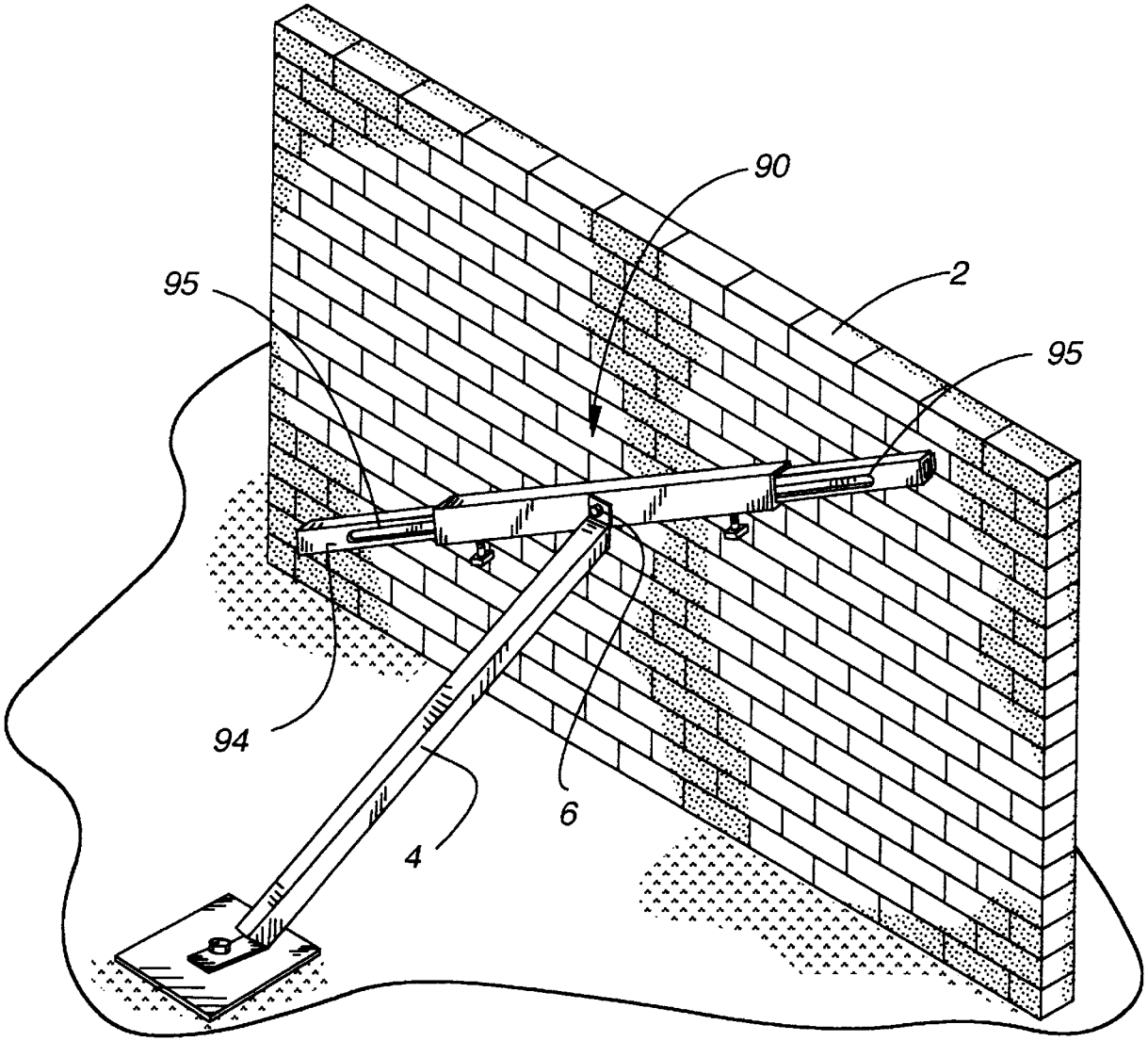
FIG. 11 is an illustration of the alternative embodiment of the present invention as applied in the construction of a wall.

FIG. 11 illustrates an alternative embodiment of the present invention. While the above discussion has focused on an adjustable supporting brace that has multiple members, a single member may also be used. In this alternative embodiment, adjustable brace 90 has a single member 92. The single member 92 may be a continuous tubular piece, and has at least one telescoping arm 94. If the telescoping arm 94 has a length that exceeds the length of the single member 92, the telescoping arm can easily be extended to support areas of the wall 2 far beyond the initial orientation of the adjustable brace 90. In the case that the single telescoping arm 94 is used, slot 95 is included to allow the telescoping arm 94 to slide freely about the connection 6. However, multiple telescoping arms may be used, as illustrated in FIGS. 4A–5C. The adjustable brace 90 also may incorporate the locating tabs 53, 55, 83, and 85 as described above, as well as foot 61. Adjustable brace 90 may also be attached to the wall 2 in a similar fashion as adjustable brace 10, and also may connect to pole brace 4 as in the previous embodiment.

While an improved method and apparatus for bracing a wall during construction has been shown and described in detail in this application, it is to be understood that this invention is not to be limited to the exact form disclosed and changes in detail and construction of the various embodiments of the invention may be made without departing from the spirit thereof.

We claim:

1. An adjustable supporting brace for constructing a wall, said adjustable brace comprising:

(a) an inner member, said inner member having length, a first section, a second section, and a center section, said center section connecting said first and second sections, said center section having connection means connecting said inner member to said wall, said center section having at least one flanged means for connecting said supporting brace to a support pole;

(b) at least one outer member, said outer member having length, a first section, a second section, and a center section, said center section connecting said first and second sections of said outer member, said center section having connection means connecting said outer member to said inner member; and (c) an attachment means, said attachment means attaching said center section of said inner member and said center section of said outer member to said wall such that said inner member and said outer member may rotate independent of each other about said attachment means.

2. The adjustable brace as defined in claim 1, further comprising extendable arms contained in said first and second sections of said inner member and said first and second sections of said outer member, said extendable arms extending from said first and second sections of said inner member and said first and second sections of said outer member, said extendable arms retractable into said first and second sections of said inner member and said first and second sections of said outer member.

3. The adjustable brace as defined in claim 2, further comprising locating means locating said extendable arms within said first and second sections of said first and outer members.

4. The adjustable brace as defined in claim 2, further comprising attaching means to affix said extendable arms when extended to desired lengths.

5. The adjustable brace as defined in claim 2, further comprising positioning means positioning said extendable arms proximate to said wall.

6. The adjustable brace as defined in claim 2, further comprising means to remove foreign matter from said extendable arms when said extendable arms are retracted.

7. The adjustable brace as defined in claim 2, further comprising retaining means preventing said extendable arms from dislocating from said first and second sections.

8. The adjustable brace as defined in claim 1, further comprising a cross member means, said cross member means connecting one of said first and second sections of said inner member to one of said first and second sections of said outer member.

9. The adjustable brace as defined in claim 8, wherein said cross member means has adjustable length to position inner and outer members at a desired angle with respect to each other.

10. The adjustable brace as defined in claim 9, wherein said cross member means comprises at least one extendable arm to adjust the length of said cross member means by extending from said cross member means and retracting into said cross member means.

11. The adjustable brace as defined in claim 10, further comprising locating means locating said extendable arm within said cross member means.

12. The adjustable brace as defined in claim 10, further comprising means to remove foreign matter from said extendable arm when said extendable arm is retracted into said cross member means.

13. The adjustable brace as defined in claim 10, further comprising retaining means retaining said extendable arm from dislocating from said cross member means.

14. The adjustable brace as defined in claim 10, further comprising attaching means affixing said extendable arm when extended to desired lengths.

15. The adjustable brace as defined in claim 8, further comprising means raising said supporting brace to a desired height.

16. A method of bracing an area of a wall during construction, comprising the following steps: (a) providing an adjustable brace having two or more members, said members having extendable arms capable of extending from said members; (b) mounting said adjustable brace to a wall on a pivot bolt/sleeve attaching the centers of the members to the wall such that said members may rotate independently of each other; (c) attaching an extendable cross brace between adjacent ends of said members; (d) attaching a pole brace between the ground and said adjustable brace; and (e) extending said extendable arms upward from said members while extending said cross brace between said extendable arms to brace additional areas of the wall as said additional areas are constructed upward all without having to reposition the pivot bolt/sleeve.

17. The method of bracing as described in claim 16 wherein said steps (a), (b), (c), and (e) are repeated for an additional adjustable brace located on the opposite side of the wall as the first adjustable brace, where said adjustable brace and said additional adjustable brace share a common connection to said wall.

18. A method of bracing an area of a wall during construction, comprising the following steps: (a) providing an adjustable brace having one member, said member having a center, said member having one or more extendable arms adjustably extending from said member; (b) mounting said adjustable brace to a wall by attaching said member to the wall such that said member may rotate ; (c) attaching a pole brace between the ground and said adjustable brace; and (d) extending said extendable arms from said member to brace additional areas of the wall as said additional areas are constructed upward all without having to reposition the pole or the attached brace.

19. The method of bracing as described in claim 18, wherein said steps (a), (b), and (d) are repeated for an additional adjustable brace located on the opposite side of the wall as the first adjustable brace, where said adjustable brace and said additional adjustable brace share a common connection to said wall.

* * * * *